US005142795A

United States Patent [19]

Abbott

[11] Patent Number: 5,142,795

[45] Date of Patent: Sep. 1, 1992

[54] INFRA-RED LAMP MODULE

[75] Inventor: Ronald E. Abbott, Marion, Ohio

[73] Assignee: ABB Process Automation Inc., Columbus, Ohio

[21] Appl. No.: 605,048

[22] Filed: Oct. 29, 1990

[51] Int. Cl.[5] ..... F26B 23/04; H05B 3/42

[52] U.S. Cl. ..... 34/41; 34/39; 34/155; 34/156; 219/388; 392/411; 392/423; 392/424

[58] Field of Search ..... 34/4, 39, 41, 42, 155, 34/156; 219/388; 392/411, 423, 424

[56] References Cited

U.S. PATENT DOCUMENTS

| | | | |
|---|---|---|---|
| 3,217,139 | 11/1965 | Barber | 392/411 |
| 3,355,574 | 11/1967 | Bassett, Jr. | 392/411 X |
| 3,788,560 | 1/1974 | Hough et al. | 392/424 X |
| 3,956,612 | 5/1976 | Ballard et al. | 392/411 X |
| 4,010,348 | 3/1977 | Salinger | 392/423 |
| 4,101,759 | 7/1978 | Anthony et al. | 392/411 |
| 4,406,944 | 9/1983 | Crain et al. | 219/388 |
| 4,494,316 | 1/1985 | Stephansen et al. | 34/41 X |
| 4,551,616 | 11/1985 | Buttery | 392/411 X |
| 4,949,478 | 8/1990 | Socha | 34/155 |

*Primary Examiner*—Henry A. Bennet
*Assistant Examiner*—Christopher B. Kilner
*Attorney, Agent, or Firm*—Paul J. Lerner

[57] ABSTRACT

An apparatus for drying a moving web includes an elongate support frame, disposed transverse the web, and a number of heater modules releasably attached thereto. The heater modules each include a housing and an inner panel assembly releasably captured therein. An openable cover, in the housing, provides for ready insertion or removal of the inner panel assembly, which rests on two mutually perpendicular support members and is clamped against one of them by the closed cover. A number of heating elements are operatively supported on the inner panel assembly by means which include a locking member displaceable between a first position, whereat all of the heater elements are locked in position, and a second position, whereat the heater elements may be removed.

8 Claims, 9 Drawing Sheets

INFRA-RED LAMP MODULE

BACKGROUND AND SUMMARY OF THE INVENTION

The present invention relates to apparatus for drying a moving web and, more particularly, to such an apparatus utilizing radiant heaters disposed on a frame transverse to the web.

During the process of making paper, moisture must be removed from a continuously moving paper sheet or web. This is primarily accomplished by passing the sheet or web between revolving, steam-filled cylindrical drums which convert much of the trapped moisture to steam.

Further moisture removal is commonly achieved through the use of infra-red dryer systems, which perform two primary functions. Firstly, they provide additional heat, uniformly across the moving web, thereby speeding the drying of the web and permitting a corresponding increase in the production rate. Secondly, through appropriate power control, they provide additional, localized heat to effectively dry high moisture areas which may occur at varying points across the web.

Typically, infra-red dryer systems comprise a number of lamp modules mechanically fastened to one or more support frames extending across the web. The support frames generally serve as a duct to supply cooling air to the functional components and also serve as a cable tray to deliver power to the individual lamp modules.

The modules generally each comprise a sheet metal housing, a number of electric infra-red heater lamps, an internal reflector, a protective transparent window, internal electrical connections, and integrated ducting for operational cooling. All of these components, and the various fasteners which hold them together, are subjected to intense heat and also to the effects of thermal expansion during operation. In addition, infra-red heater lamps tend to fail on unpredictable time schedules. Scheduled maintenance periods are normally brief, requiring immediate and efficient action.

Present infra-red lamp module designs are such as to require that several components, as well as various fasteners, be removed to gain access to the internal components for service. The process of removing a lamp module from a support frame, and then removing and repairing or replacing defective components, is commonly a time consuming function. Often, this results in a lack of sufficient time to service all of the lamp modules within a dryer system. Further problems may arise during servicing, when dissembled components or fasteners are subject to loss or damage.

It is, therefore, a primary object of the present invention to provide an improved web heating or drying system which avoids the aforementioned shortcomings and limitations of the prior art. More specifically, it is an object to provide such a system wherein the lamp or heater modules may be readily removed from and replaced on their support frames and wherein the various components of the individual modules may be readily removed therefrom for servicing or replacement.

It is a further object to provide such a system which utilizes a minimum number of components and fasteners, whereby the costs of system fabrication, assembly and installation may also be reduced.

The foregoing and other objects and advantages of the invention are achieved by an apparatus of the type including an elongate support frame and a plurality of heater modules releasably attached thereto, wherein the heater modules each include a housing and an inner panel assembly releasably captured therein. An openable cover, in the housing, provides for easy insertion or removal of the inner panel assembly. A plurality of lamps are operatively supported on the inner panel assembly by means which include a locking member displaceable between a first position, whereat all of the lamps are locked in position, and a second position, whereat the lamps may be removed.

More particularly, the inner panel assembly rests on two mutually perpendicular support members in the housing and is clamped against one of them by the closed cover.

DETAILED DESCRIPTION OF THE PREFERRED EMBODIMENT

Figure 1:
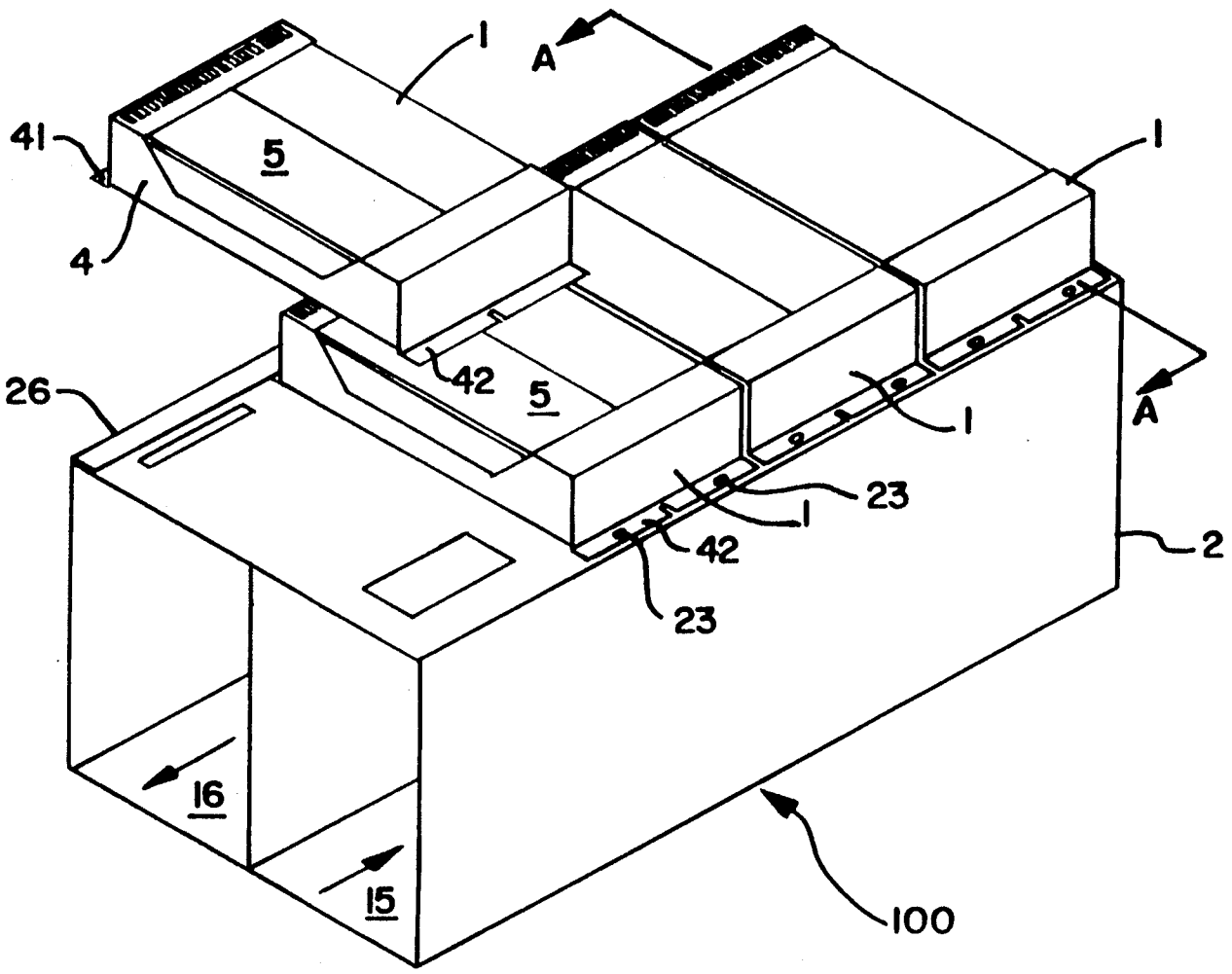
FIG. 1 is a perspective view of an infra-red dryer system in accord with the present invention.

Turning now to the drawings, there is shown generally in FIG. 1, an infra-red dryer system 100 comprising a support frame 2 and a plurality of lamp or heater modules 1 releasably attached thereto, in side-by-side abutting relation, as will be more fully described hereinafter. Support frame 2 is disposed transverse the web (not shown) with the lamp modules 1 being closely adjacent thereto.

Support frame 2 is a generally cylindrical member, preferably formed of sheet metal, defining an air supply duct 15 and an exhaust duct 16. A flange-receiving support track 26 is formed along an edge of support frame 2.

Figure 2:
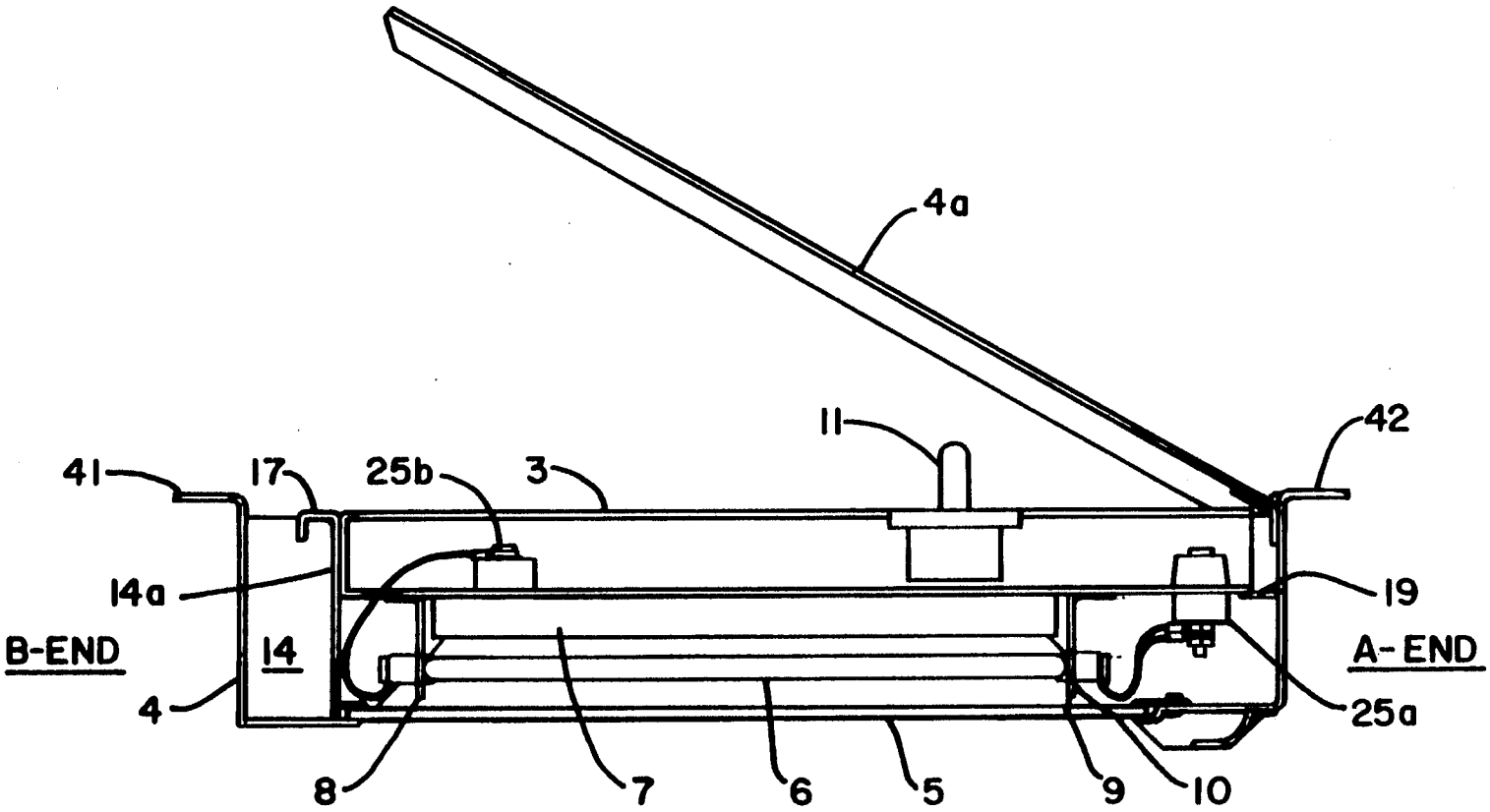
FIG. 2 is a cross-sectional view, taken along line A—A of FIG. 1.
Figure 3:
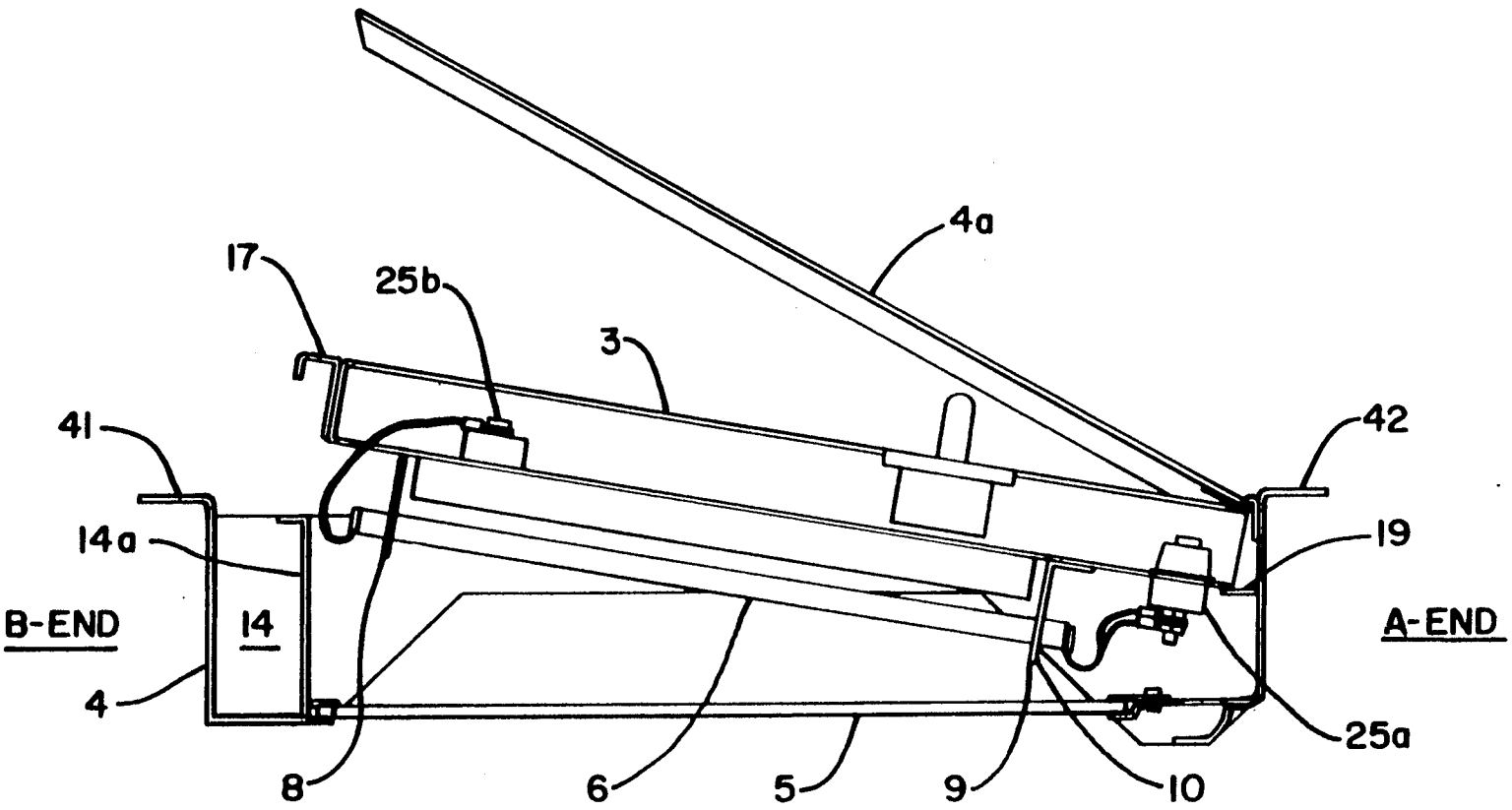
FIG. 3 is a cross-sectional view, similar to FIG. 2, showing the inner panel assembly partly removed from the housing.

As best seen in FIGS. 2 and 3, lamp modules 1 each comprise a box-like housing 4 and an inner panel assembly 3 removably captured therein.

Housing 4, of a size to securely hold inner panel assembly 3 and prevent relative lateral movement thereof, is preferably formed of sheet metal and includes a protective cover lens 5 in one face and a hinged rear cover 4*a* in the opposing face. Cover 4*a* is normally secured in the closed position, as illustrated in FIG. 1, by a captive fastener (not shown); however, an interference fit connection may be utilized. A pair of outwardly projecting flanges 41 and 42 are formed at opposite ends of housing 4, flange 42 being adapted to receive removable fasteners 23. Internally of housing 4, are two mutually perpendicular support members 14*a* and 19, on which inner panel assembly 3 rests. Support member 14*a* further serves to define an air return chamber 14, within housing 4, which communicates with air supply duct 15 of support frame 2. Cover 4*a*, in its closed position, clamps inner panel assembly 3 against support member 14*a*.

Lamp modules 1 are each releasably attached to support frame 2 by inserting flange 41 into support track 26 and securing flange 42 in position with fasteners 23. It should be appreciated that lamp modules 1 are readily removable from support frame 2 to allow servicing or replacement by another module.

Figure 4:
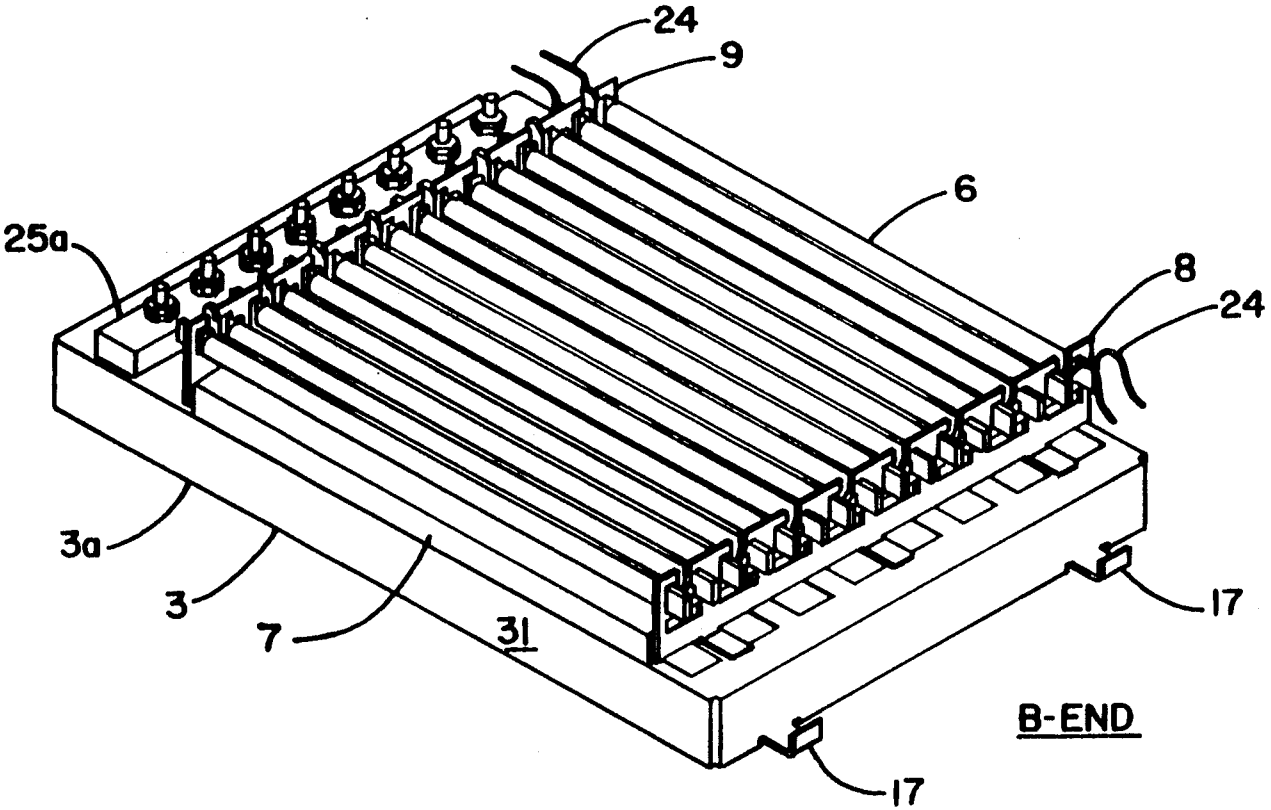
FIG. 4 is a perspective view of the inner panel assembly.
Figure 5:
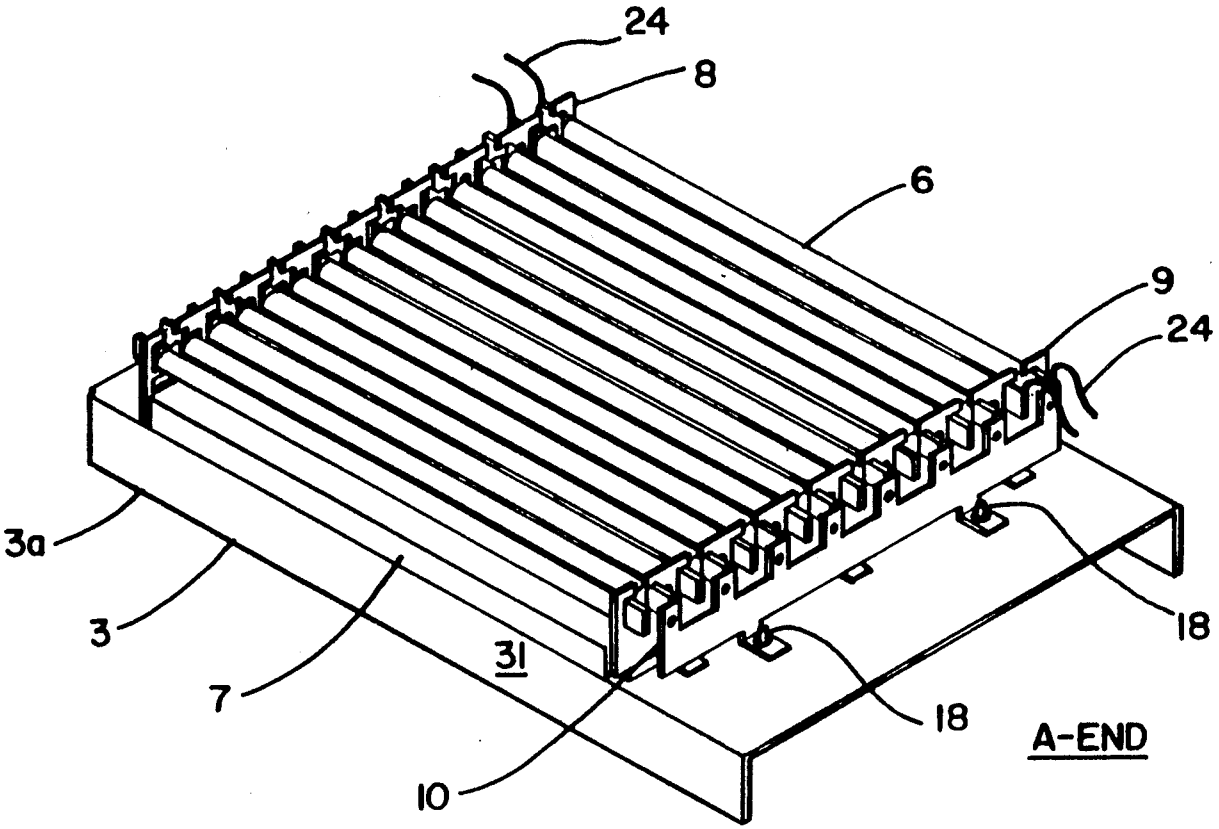
FIG. 5 is a second perspective view of the inner panel assembly, with lamp connectors removed.

As best seen in FIGS. 4 and 5, inner panel assembly 3 comprises a base or frame 31, preferably formed of sheet metal, on which are mounted an external electrical connector 11 and, at either end, electrical lamp connectors 25*a* and 25*b*. A reflector pad 7 underlies a plurality of infra-red lamps 6. Hook-like alignment tabs 17, adapted to engage support member 14*a* as illustrated in FIGS. 2 and 3, project from an end of frame 31. In addition to their support function, as hereinafter explained, alignment tabs 17 also restrain movement of inner panel assembly 3 in the direction parallel to lamps 6. It should be appreciated that inner panel assembly may be removed from housing 4 merely by opening hinged cover 4*a* and lifting alignment tabs 17, as seen in FIG. 3. Access to lamps 6 may thus be conveniently had.

Figure 6:
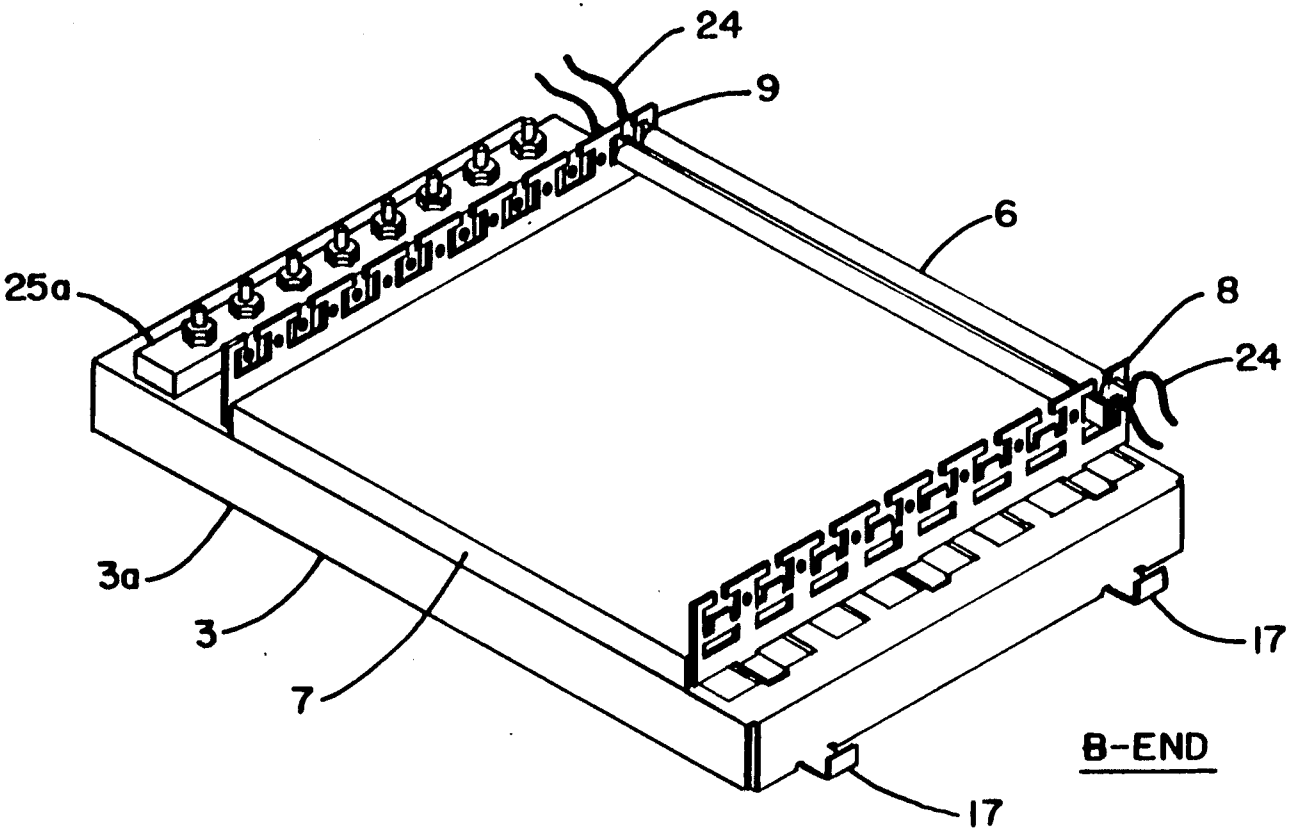
FIG. 6 is a perspective view, similar to FIG. 4, with several of the lamps removed.
Figure 6B:
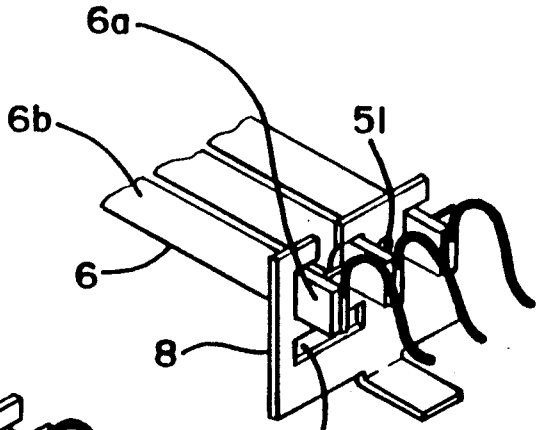
FIGS. 6*a* and 6*b* are fragmentary perspective views showing the method of installation of lamps.
Figure 6A:
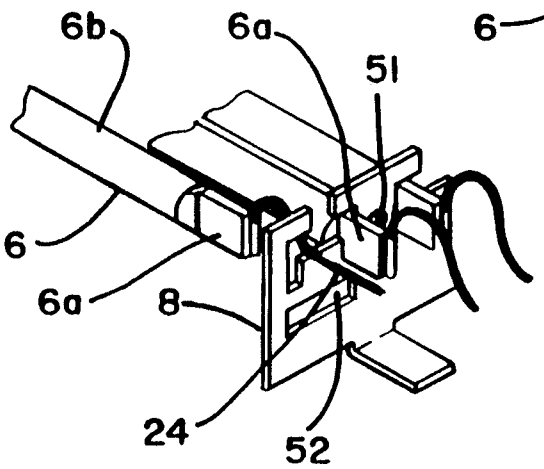
Figure 7:
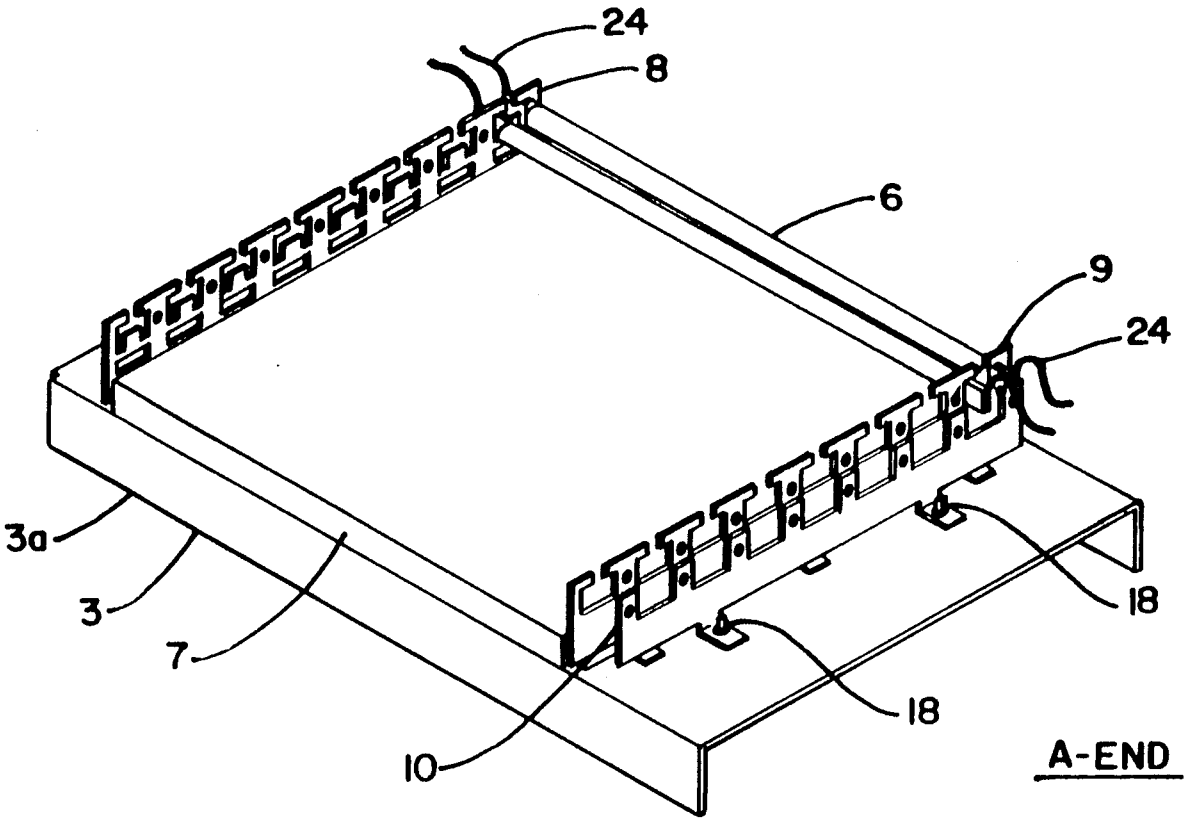
FIG. 7 is a perspective view, similar to FIG. 5, with several of the lamps removed.
Figure 7A:
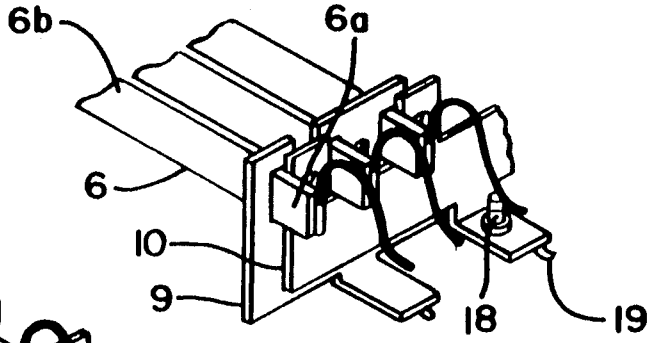
FIGS. 7*a*, 7*b* and 7*c* are fragmentary perspective views showing the method of installation and locking of the lamps.
Figure 7B:
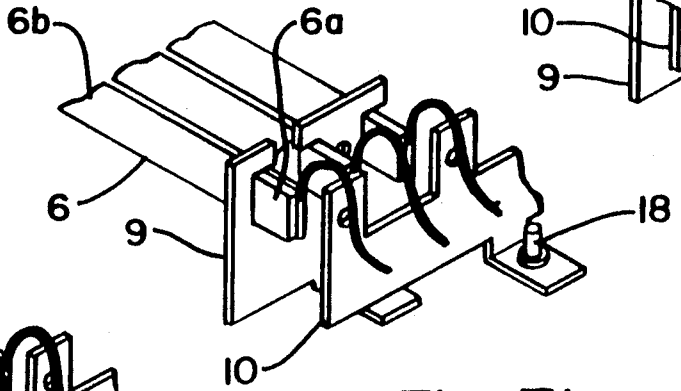
Figure 7C:
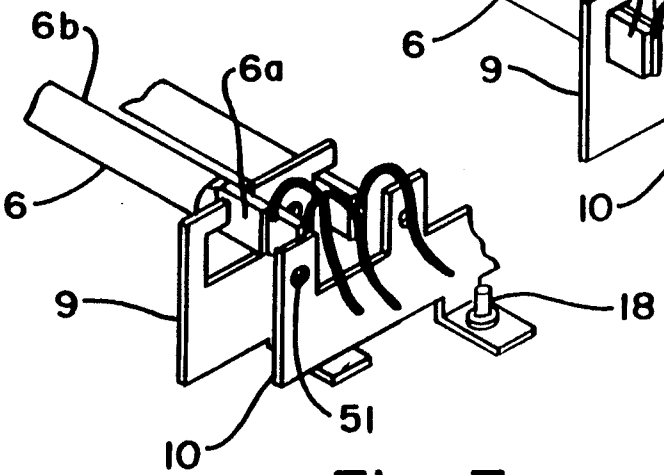

Turning now to FIGS. 6 through 7*c*, it is seen that lamps 6 are held in lamp supports 8 and 9 non-removably disposed at either end of frame 31 of inner panel assembly 3. A lamp retainer 10 is slidably mounted on frame 31, adjacent lamp support 9. With lamp retainer 10 in its service position, shown in FIGS. 7, 7*a* and 7*b*, lamps 6 may be installed in lamp supports 8 and 9, as illustrated in FIGS. 6*a*, 6*b*, 7*a* and 7*b*. Thereafter, lamp retainer 10 is displaced to abutting relation with support member 9, as shown in FIG. 7*c*, securely locking lamps 6 in position. Lamp retainer 10 is attached to frame 31 by fasteners 18 which slide in grooves 19; however, alternative means for providing the desired range of movement may be employed.

Lamp supports 8 and 9, and lamp retainer 10, include numerous air ports 51 and directional openings 52 to provide a turbulent air flow to aid in cooling lamps 6. It is to be noted that lamp supports 8 and 9 and lamp retainer 10 engage lamp end seals 6*a*, rather than the more fragile lamp bodies 6*b*, thus minimizing the probability of lamp breakage. Lamp support 9 and lamp retainer 10 combine to engage lamp end seal 6*a* about its entire periphery. Despite this secure retention, however, lamp 6 remains free to thermally expand in any direction.

I claim:

1. In an apparatus for heating a movable web, of the type including an elongate support frame and a plurality of heater modules releasably attached to said support frame; the improvement comprising:

said heater modules each comprising a housing and an inner panel assembly releasably captured therein;

said housing including a cover, having an open position and a closed position, allowing insertion and removal of said inner panel; and means on said inner panel assembly operably supporting a plurality of heater elements, said means including a captive locking member slidably displaceable between a first position, whereat all of said heater elements are locked in position, and a second position, whereat all of said heater elements may be removed.

2. The apparatus of claim 1, wherein said housing includes two mutually perpendicular support members, said inner panel assembly resting on said support members and said cover, when in said closed position, clamping said inner panel assembly against one of said support members.

3. The apparatus of claim 2, wherein one of said support members defines an air return chamber in said housing.

4. The apparatus of claim 3, wherein said support frame includes means defining an air supply duct and an exhaust duct.

5. The apparatus of claim 4, wherein said air return chamber communicates with said exhaust duct.

6. The apparatus of claim 1, wherein each of said heater modules includes a projecting flange and said support frame includes a support track adapted to receive said flange.

7. The apparatus of claim 1, wherein said heater elements are infra-red lamps, said infra-red lamps each comprising a central body portion and a pair of end seals, said means supporting said infra-red lamps solely by engaging said end seals.

8. The apparatus of claim 7, wherein said means engages at least one of said end seals of each of said infra-red lamps about its entire periphery.

* * * * *